US007080540B2

(12) United States Patent
Taillepied et al.

(10) Patent No.: US 7,080,540 B2
(45) Date of Patent: Jul. 25, 2006

(54) FORMING TOOL FOR FORMING THE UNDULATING HEAT EXCHANGER SURFACES OF A HEAT EXCHANGER VIA COLD BENDING OF A SHEET AND A METHOD FOR THE REALIZATION OF THE FORMING PROFILE OF SUCH A TOOL

(75) Inventors: Daniel Taillepied, Eaubonne (FR); Catherine Fourmont, Soisy sous Montmorency (FR); André Rolland, Epinay sur Seine (FR)

(73) Assignee: Societe d'Etudes et de Constructions Aero-Navales (FR)

( * ) Notice: Subject to any disclaimer, the term of this patent is extended or adjusted under 35 U.S.C. 154(b) by 45 days.

(21) Appl. No.: 10/371,236

(22) Filed: Feb. 20, 2003

(65) Prior Publication Data

US 2004/0055355 A1 Mar. 25, 2004

(30) Foreign Application Priority Data

Feb. 21, 2002 (FR) ..... 02 02215

(51) Int. Cl.
*B21D 13/02* (2006.01)
*B21D 53/04* (2006.01)
*B21P 15/26* (2006.01)

(52) U.S. Cl. ..... 72/385; 72/379.1; 72/386; 72/389.3

(58) Field of Classification Search ..... 72/379.1, 72/385, 386, 389.3
See application file for complete search history.

(56) References Cited

U.S. PATENT DOCUMENTS

| | | | | |
|---|---|---|---|---|
| 4,008,591 A | * | 2/1977 | Vos et al. | 72/385 |
| 4,346,760 A | * | 8/1982 | Vidal-Meza | 72/385 |
| 4,450,705 A | * | 5/1984 | Vidal-Meza | 72/385 |
| 5,694,803 A | | 12/1997 | Ervin et al. | |

FOREIGN PATENT DOCUMENTS

| | | |
|---|---|---|
| GB | 584575 | 1/1945 |
| WO | WO 82/02940 | 9/1982 |

* cited by examiner

*Primary Examiner*—David B. Jones
(74) *Attorney, Agent, or Firm*—Robert W Becker & Associates; Robert W. Becker

(57) ABSTRACT

This invention is a device for forming heat exchange elements with corrugated heat exchange surfaces, more particularly inserts, made of a sheet in a formable material, such as metal, between two surfaces, each thus presenting a corrugated profile.

This device is of the type comprising at least two plates whose opposing faces present the said corrugated profiles and which are offset from each other so as to define between them a space to take the sheet to be formed (2). The device is distinguished by the fact that the profiles (A and B) are configured in such a way that their displacement in the direction of the thickness of the insert is constant along the corrugations in the space between the profiles.

The invention can be used for the production of inserts.

3 Claims, 2 Drawing Sheets

Fig. 1
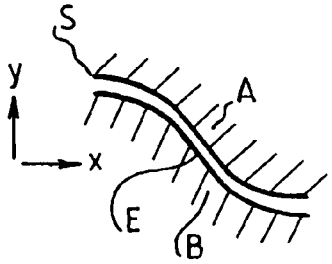
Fig. 2
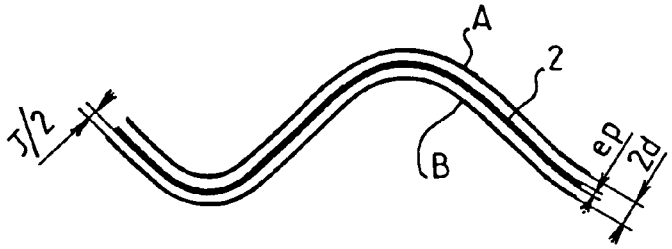
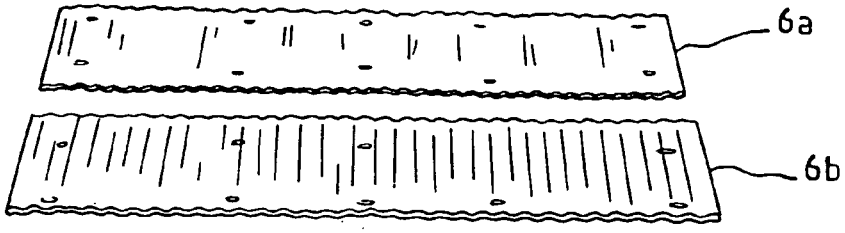
Fig. 3
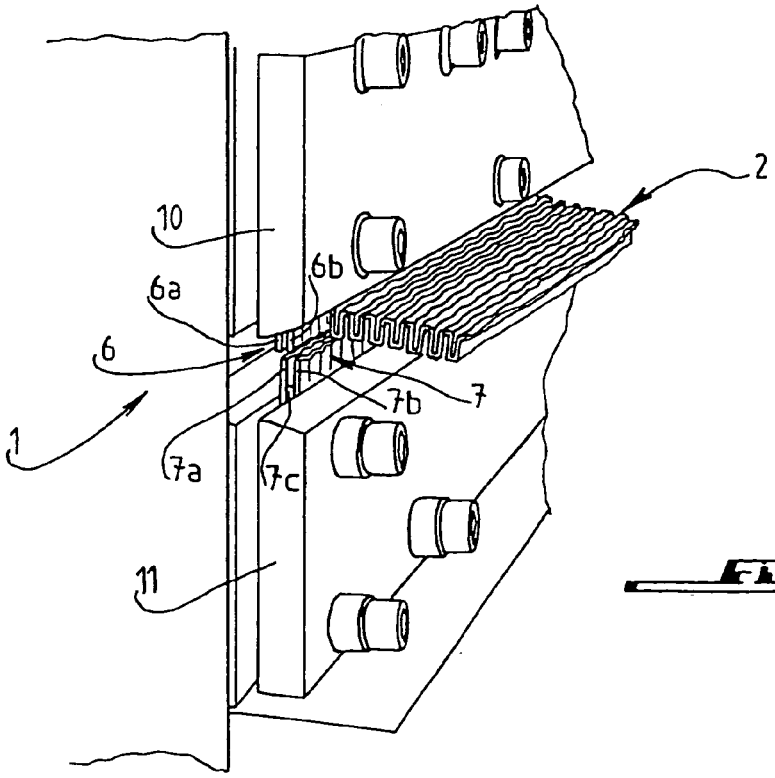
Fig. 4

FORMING TOOL FOR FORMING THE UNDULATING HEAT EXCHANGER SURFACES OF A HEAT EXCHANGER VIA COLD BENDING OF A SHEET AND A METHOD FOR THE REALIZATION OF THE FORMING PROFILE OF SUCH A TOOL

FIELD OF THE INVENTION

The invention relates to a device for forming heat exchange elements with corrugated heat exchange surfaces, in particular inserts, from a sheet in a formable material, such as metal, between two surfaces, each having a corresponding corrugated forming profile, of the type comprising at least two plates whose opposing faces have said corrugated profiles and which are separated from each other so as to define therebetween a space for receiving the sheet to be formed. The invention also relates to a method for producing the profiled surfaces of the plates of this device for forming corrugated heat exchange surfaces.

Forming devices of this type already exist which have an upper plate and a lower plate whose forming surfaces have identical profiles and which can be positioned by a translational movement of one plate relative to the other.

BACKGROUND AND OBJECT OF THE INVENTION

The existing forming device has the drawback illustrated in accompanying FIG. 1 in that the space for receiving the formed sheet, i.e. the insert, is not constant in the direction of the corrugation. Actually, since profiles A and B are identical, the separation in the y direction is obviously constant for all the values of x in a system of x, y coordinates, but the thickness in the inclined areas, such as, for example, at point E is less than that at the top areas S of the profiles. As a result, the existing forming devices do not allow one to obtain the best shape at every point of the heat exchange surfaces and, moreover, cause tears where the space for receiving them is the narrowest.

The present invention aims at proposing a forming device of the type mentioned above and a method for producing the forming plates, which alleviate the above-mentioned drawbacks.

SUMMARY OF THE INVENTION

In order to achieve this aim, the forming device of the invention is characterized in that the profiles are configured so that their separation in the direction of the thickness of the insert is constant along the corrugations in the space between the profiles.

The method for producing the profiles of the invention is characterized in that it consists in defining the curve which passes through the center of the sheet formed between the two profiles and establishing, as forming profiles, those that are obtained by adding a constant distance on both sides of the curve for each of the points thereof, in a direction perpendicular to this curve.

According to a distinctive feature of the invention, the constant distance is equal to the sum of the thickness of the insert and of the play or clearance necessary to the forming, divided by two.

BRIEF DESCRIPTION OF THE DRAWINGS

The invention will be better understood, and other aims, features and advantages thereof will become clearer in the following explanatory description with reference to the accompanying diagrammatic drawings, given only as an example, illustrating an embodiment of the invention and in which:

FIG. 1 is a diagrammatic view of a forming device according to the state of the art;

FIG. 2 illustrates the paired profiles of the two cooperating plates of the forming device of the invention, in order to illustrate the making of these profiles;

FIG. 3 is a perspective view of a forming plate;

FIG. 4 is a simplified perspective view of a machine for forming heat exchange surfaces, equipped with a forming device of the invention;

DETAILED DESCRIPTION OF A PREFERRED EMBODIMENT

Figure 5:
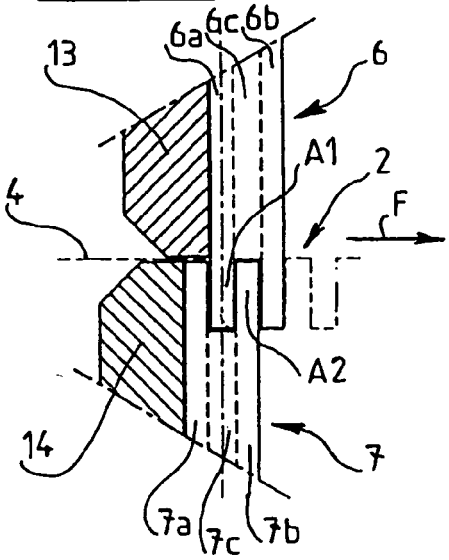
FIGS. 5 to 10 illustrate various steps for forming heat exchange surfaces with the help of the forming device illustrated in FIG. 4.
Figure 6:
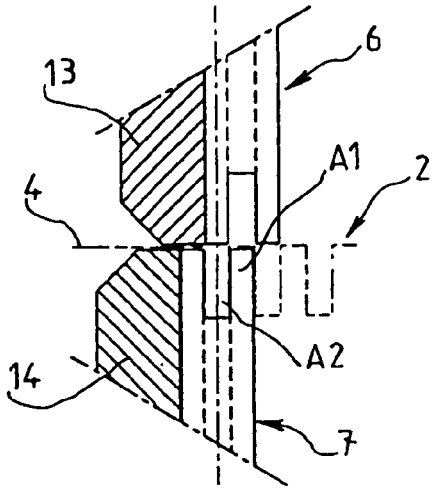
Figure 7:
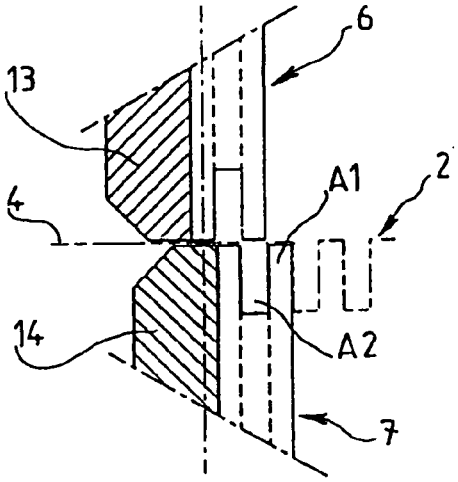

To make it easier to understand the invention, a description will be made, before showing the invention, of the general structure of a machine equipped with a device for forming heat exchange surfaces, with reference to FIGS. 3 to 10.

FIG. 4 shows a forming machine 1 for forming a corrugated strip, hereafter called an insert, obtained by cold-folding a sheet 4 indicated diagrammatically in FIGS. 5 to 10, but which is not shown in FIG. 4. The forming is achieved with the help of an upper forming tool 6 and a lower tool 7. The upper tool 6 and the lower tool 7 are each made up of two forming plates and a separation plate, which determines the space between the two forming plates. Thus the upper tool 6 comprises the two forming plates 6*a* and 6*b* and the separation plate 6*c*, whereas the lower tool 7 comprises the two forming plates 7*a* and 7*b* and, between these two plates, the separation plate 7*c*. The upper tool 6 is mounted on a vertically movable tool holder 10, whereas the lower tool is mounted on a lower tool holder 11 which is horizontally movable. In the upper and lower tools 6 and 7, strippers, 13 and 14 respectively, are associated, which are there to guide and support the sheet 4 during the forming thereof.

As for the sheet in its formed state or insert 2, it is folded so as to be made up of a succession of fins A3 and A4, in a direction of the arrow F, which fins are open alternately towards the top and the bottom, each fin having a U-shaped cross-section. On the other hand, in a direction at right angle to the arrow F, each fin has a corrugated profile.

It is easy to understand that height and pitch of the fins and geometry of the profile of their lateral surfaces are determined by dimensions of the plates, the shape thereof and their positions relative to each other.

To form the fins and their corrugated surfaces, the sheet in the form of a continuous strip is introduced at the back of the machine shown in FIG. 4, passes between the upper 6 and lower 7 plates, to be formed by successive alternate folding, and is guided on a supporting casing where a rough cutting of the formed insert (not shown) will take place. The upper and lower strippers 13 and 14 allow the sheet to be guided and to hold the sheet on the lower 7*a* and 7*b* or upper 6*a* and 6*b* plates following progression of the forming cycle. These strippers are only connected to the tools in their horizontal movements.

A forming cycle can be broken down into six successive stages corresponding to FIGS. 5 to 10.

Figure 8:
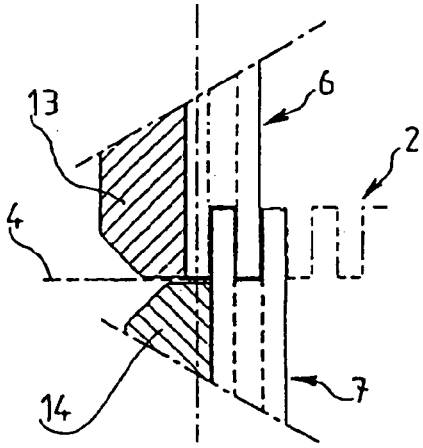
Figure 9:
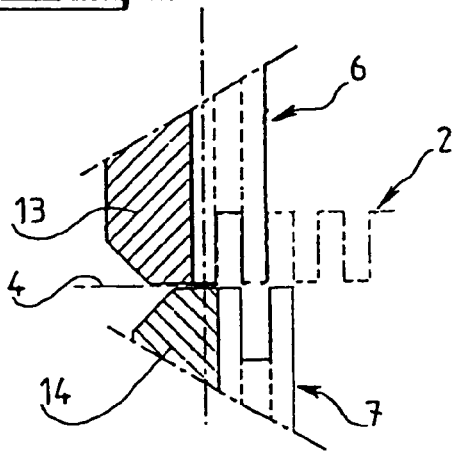
Figure 10:
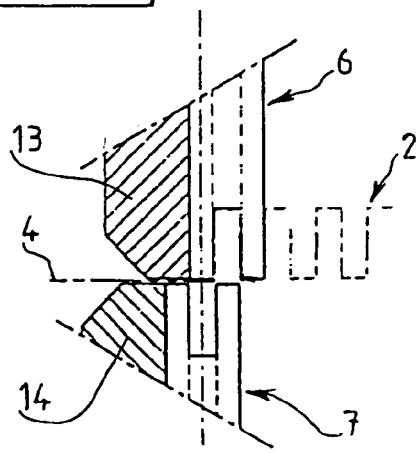

FIG. 5 shows the first stage during which the upper tool 6 forms the fin A2 which is open towards the top, for the first time, and forms the fin A1, which is open towards the bottom, for the second time. The strippers 13 and 14 will guide and support the sheet during the forming process. In the second stage, the upper tool 6 disengages by moving up and the strippers 13 and 14 will hold the pressed sheet on the lower tool 7. In the third stage, illustrated in FIG. 7, the lower tool 7 moves horizontally to the right and thus puts itself in position for production of the fin A2, for the second time, and of the fin A3, for the first time. FIG. 8 shows the fourth stage during which the upper tool 6 forms the fin A3, which is open towards the bottom, for the first time, and forms the fin A2, for the second time, the strippers 13 and 14 guiding and supporting the sheet during forming. In the fifth stage, the pressed sheet is supported by the strippers on the upper tool 6, which disengages. Finally, FIG. 10 illustrates that, in the sixth stage, the lower tool 7 puts itself in position to carry out forming of the fin A3, for the first time, and of the fin A4, for the second time. At end of these six stages, the forming cycle starts again at the first stage.

As mentioned above, with reference to FIG. 1, the forming devices used to date have the major drawback that the space to receive the sheet is not uniform along the corrugations. The invention proposes a method that allows the production of forming devices that alleviate the drawback of an irregular thickness along the corrugations.

FIG. 2 illustrates the method in the invention. This figure shows the paired profiles of an upper plate, for example 6*a*, and of a lower plate 6*b* providing therebetween the corrugation of the insert 2, as determined by the profiles of the forming plates, to the sheet 4. The thickness of the insert is indicated by the reference ep. One can ascertain on both sides of the insert 2 a play or clearance j/2 whose dimensions are exaggerated in relation to the thickness of the sheet and which is provided to take into account, for example, a film of lubricant.

In general, the method of the invention consists in establishing the curve of the insert in the center thereof and then adding, in a direction perpendicular to this curve, on both sides of it, a constant distance d which is equal to a sum of the thickness ep of the insert and of the play j needed for the forming, divided by two, i.e. equal to formula:

$$d = \frac{ep + j}{2}$$

By way of example, a description is given below of the method of the invention as applied to a profile with sinusoidal corrugation.

The curve of the insert, which will thus be a sinusoidal curve, is then, in Cartesian coordinates, of the type:

$$y = a\sin(bx)$$

For determining the two paired profiles according to FIG. 2, one calculates for each point of the curve two other points situated on a perpendicular to this curve, on both sides of the latter, at the constant distance d as indicated above. These points are those which define the two paired profiles.

More precisely, for an insert with sinusoidal corrugation, so as to determine the Cartesian coordinates of the points for the paired profiles, one calculates the angle of the tangent at each point of the base curve, for example P1, then one adds to the Cartesian coordinates x1, y1 of this point:

d sin(θ+π), on the X-axis, and d cos(θ), on the Y-axis, for one of the paired profiles, and d sin(θ), on the X-axis, and d cos(θ+π), on the Y-axis, for the second paired profile.

The Cartesian coordinates xc1, xc2, yc1 and yc2 of these two points as established on both sides of the base curve, and which are situated on the two profiles to be obtained are as follows:

$$xc1 = x1 + d\sin(\theta+\pi);\ \text{and}\ yc1 = y1 + d\cos(\theta)$$

$$xc2 = x1 + d\sin(\theta);\ \text{and}\ yc2 = y1 + d\cos(\theta+\pi)$$

The upper and lower tools, thus determined, are advantageously made of a strongly alloyed steel (molybdenum cobalt, chrome, tungsten and vanadium) and treated at a very high hardness e.g. 66 Hrc. The mathematical definition of the profile allows a manufacturing method on an automatic machine.

Obviously, the invention allows a production of profiles for forming corrugated inserts of any desired shape. It is only necessary to establish, advantageously through mathematics, the central curve of the insert and to define the points of the paired forming profiles according to the above explained method.

The invention thus allows a forming of sheets of constant thickness, while avoiding a risk of tearing, which is inherent in the method of producing inserts according to the state of the art.

The specification incorporates by reference the disclosure of French priority document 02 02 215 of Feb. 21, 2002.

The present invention is, of course, in no way restricted to the specific disclosure of the specification and drawings, but also encompasses any modifications within the scope of the appended claims.

The invention claimed is:

1. A device for forming heat exchange elements having corrugated heat exchange surfaces from a sheet of formable material, comprising:

a first part having two spaced apart plates having a corrugated surface profile; and a second part having two plates that are spaced apart by the same distance as are the plates of said first part and that also have said corrugated surface profile, wherein said first and second parts are movable into and out of a sheet corrugation-forming position in which said sheet is disposed in a space provided between two of said corrugated surface profiles of opposing ones of said plates of said first and second parts for having a sheet corrugation formed in said sheet, wherein said plates have substantially the same thickness, wherein the sheet, when provided with said sheet corrugation, has a substantially uniform thickness along its corrugation, and wherein a distance between two opposing corrugated surface profiles of said plates in said sheet corrugation-forming position is constant in a direction of a thickness of the sheet along the corrugations thereof and is greater than such thickness of the sheet by an amount that allows for the presence of a film of lubricant between the sheet and said opposing corrugated surface profiles.

2. A method for making the corrugated surface profiles of the plates of the first and second parts of the device of claim 1, including the steps of defining a curve that passes through a center of said sheet disposed between the two corrugated surface profiles, and establishing, as corrugated surface profiles, those obtained by adding on opposite sides of said curve, at any point thereof, a constant distance taken in a direction perpendicular to said curve, said constant distance having a small value allowing for a play or clearance, such as for the presence of a film of lubricant.

3. A device according to claim 1 wherein said heat exchange elements are inserts and said formable material is metal.

* * * * *